US007901517B2

(12) United States Patent
Ecker et al.

(10) Patent No.: US 7,901,517 B2
(45) Date of Patent: Mar. 8, 2011

(54) OPERATING-PHASE-DEPENDENT CONTROL OF A HEAT-RECOVERY DEVICE IN DISHWASHERS

(75) Inventors: Engelbert Ecker, Offenburg (DE); Marcus Eggs, Offenburg (DE)

(73) Assignee: Meiko Maschinenbau GmbH & Co KG, Offenberg (DE)

( * ) Notice: Subject to any disclaimer, the term of this patent is extended or adjusted under 35 U.S.C. 154(b) by 1082 days.

(21) Appl. No.: 10/581,250

(22) PCT Filed: Jan. 19, 2005

(86) PCT No.: PCT/EP2005/000483

§ 371 (c)(1),
(2), (4) Date: Dec. 19, 2006

(87) PCT Pub. No.: WO2005/070274

PCT Pub. Date: Aug. 4, 2005

(65) Prior Publication Data

US 2007/0125403 A1 Jun. 7, 2007

(30) Foreign Application Priority Data

Jan. 26, 2004 (DE) ..... 10 2004 003 798

(51) Int. Cl.
*B08B 3/00* (2006.01)

(52) U.S. Cl. ..... 134/56 D; 134/61

(58) Field of Classification Search ..... None
See application file for complete search history.

(56) References Cited

U.S. PATENT DOCUMENTS

| | | | | | |
|---|---|---|---|---|---|
| 3,658,075 | A * | 4/1972 | Jacobs | 134/107 |
| 4,089,080 | A | 5/1978 | Beer et al. | |
| 4,184,500 | A * | 1/1980 | Herbst | 134/114 |
| 4,247,158 | A * | 1/1981 | Quayle | 312/213 |
| 5,660,195 | A * | 8/1997 | Taylor et al. | 134/58 D |
| 2002/0021051 | A1 * | 2/2002 | Jacobsen | 310/68 R |
| 2002/0175582 | A1 * | 11/2002 | Lopatinsky et al. | 310/156.01 |

FOREIGN PATENT DOCUMENTS

| | | | |
|---|---|---|---|
| DE | 22 53 624 | A1 | 5/1973 |
| DE | 27 29 878 | A1 | 1/1979 |
| DE | 196 44 438 | A1 | 4/1998 |
| DE | 19644438 | A1 * | 4/1998 |
| DE | 100 58 188 | A1 | 5/2002 |
| JP | 4-338439 | A | 11/1992 |

* cited by examiner

*Primary Examiner* — Michael Kornakov
*Assistant Examiner* — Eric Golightly
(74) *Attorney, Agent, or Firm* — Birch, Stewart, Kolasch & Birch, LLP

(57) ABSTRACT

The invention relates to a conveyor dishwasher having at least one washing zone (6, 7), at least one rinsing zone (8, 9) and a heat-recovery device (13) with a suction-extraction means. The dishwasher also comprises a drying zone (11). Openings (17, 18, 19, 20, 21) are provided for the suction extraction of air from the dishwasher. The overall quantity of the exhaust-airstream (24) can be varied by means of closing elements (25, 26, 27, 28), in dependence on the operating state of the dishwasher, by virtue of the openings (17, 18, 19, 20, 21) being completely or partially closed or released.

6 Claims, 3 Drawing Sheets

OPERATING-PHASE-DEPENDENT CONTROL OF A HEAT-RECOVERY DEVICE IN DISHWASHERS

TECHNICAL FIELD

The invention relates to a heat-recovery device which is controlled in dependence on operating phase and belongs to a dishwasher, for example a dishwasher which can be used industrially and is designed, for example, as a conveyor dishwasher.

PRIOR ART

DT 22 53 624 Z3 relates to an apparatus for the suction extraction, cooling and drying of steam from a dishwasher. This is, in particular, a multi-stage machine for catering establishments and the like from which steam passes out and which comprises a heat exchanger, which is arranged alongside the machine and has water-cooled pipe coils. Also provided are a suction-extraction apparatus and a cover which collects the steam and directs it through the heat exchanger. The water-cooled pipe coils of the heat exchanger, which are enclosed by a housing, are connected both to feed lines for the continuous cooling-water supply, which is switched on during operation, and to feed lines for the supply of additional cooling water, which can be controlled by a switching device. The switching device is controlled in dependence on the dishes, which run through the dishwasher by means of a conveyor. The switching device, for actuating a valve connected to the feedline, is arranged alongside the final stage of the dishwasher, the switching device being designed as a switch which can be actuated by a passing dish rack.

DE 25 57 182 C2 relates to a heat-recovery device for a dishwasher. This device comprises a heat pump in which an operating-fluid circuit contains, one behind the other, a compressor, at least one condenser, which serves for heating water for the dishwasher, a first expansion valve and an evaporator, which is subjected to the action of waste heat from the dishwasher. The first expansion valve is controlled in dependence on the temperature of the operating fluid on the suction side of the compressor, with the effect of limiting this temperature to the highest temperature value permissible. A second expansion valve is located parallel to the first expansion valve. This second expansion valve has a more pronounced restricting action in relation to the first expansion valve and is controlled in dependence on the pressure of the operating fluid at the inlet of the evaporator, with the effect of keeping this pressure constant. The throughflow through the first expansion valve and the second expansion valve is controlled in dependence on the temperature of the heated water such that, when the water temperature drops below a predetermined value, the throughflow through the first expansion valve is released and the throughflow through the second expansion valve is blocked. When this predetermined temperature is exceeded, the throughflow through the first expansion valve is blocked and the throughflow through the second expansion valve is released.

DE 196 44 438 C2 relates to a conveyor dishwasher and a process for cleaning dishes and/or trays. Provision is made for a cleaning zone with exit nozzles for cleaning liquor and a cleaning tank. Also provided is a rinsing zone with exit nozzles for pump-action rinsing liquid and a pump-action rinsing tank. Arranged between the exit nozzles for cleaning liquor and exit nozzles for the pump-action rinsing liquid is at least one preliminary rinsing nozzle, which is subjected to the action of pump-action rinsing liquid. The preliminary rinsing nozzle and the cleaning tank are arranged such that the pump-action rinsing liquid is fed to the cleaning tank from the preliminary rinsing nozzle.

According to the solution which is known from DE 196 44 438 C2, vapors, steam and the moisture-laden hot air are extracted by suction at the inlet of the machine and downstream of the clean-water rinsing zone. In the case of the solution which is known from DE 22 53 624 C3, the suction-extraction means is located at the end of the machine. According to the solution which is known from DE 24 57 182 C2, the heat recovery from the vapors, the steam or the moisture-laden hot exhaust air passing out of the machine is carried out via a refrigerant circuit of a heat pump rather than via a heat exchanger. According to this solution, suction extraction takes place at the inlet and at the outlet of the dishwasher.

The machine solutions which are available on the market are usually designed such that the quantities of exhaust air of the heat-recovery devices are designed for one operating state, this normally being the least favorable operating state. This means that, depending on the operating state, more air and thus more energy is withdrawn from the machine than would be absolutely necessary in order to prevent the escape of vapors and steam and to transport sufficiently dry air into the drying zone. For the operator of the machine, however, this situation means a higher level of expended energy relative to the level of energy which it would be absolutely necessary to expend.

In view of the solutions which are known from the prior art and the disadvantages of these solutions, the object of the invention is to design a dishwasher such that the escape of vapors (clouds of steam) and moisture from the dishwasher is prevented and the heat-recovery device is controlled such that the quantity of exhaust air and thus the energy dissipated from the machine are minimized.

This object is achieved according to the invention by the features of patent claim 1.

The solution which is proposed according to the invention can take account of the respective operating states of the dishwasher, in each case different quantities of vapors, steam and/or moisture-laden hot air being produced in respect of drying in the respective operating states. The following parameters influence the incidence of vapors/steam from the washing/preliminary rinsing zones and the rinsing zones and the incidence of moisture-laden hot air from the drying zone:

In respect of the respective incidence of vapors and steam, it is important as to whether wash ware is or is not located in the region of the washing/preliminary rinsing zones. It is also significant as to whether a program is a selected washing program or one which has been activated by the wash ware, it being possible for the level of the respective pumping capacities to be dependent thereon. A further parameter which is important in respect of the incidence of vapors and/or steam is whether wash ware is located in the region of the pump-action rinsing zone or in the region of the clean-water rinsing zone or in the region of the drying zone. Also important are the respective shaping of the wash ware which is to be cleaned and the temperature within the washing zones.

The solution which is proposed according to the invention can advantageously take account of the fact that different quantities of steam and/or moisture are produced at different locations in the dishwasher in dependence on the operating state of the dishwasher, i.e. in dependence on example 2 of the pumping capacity in part-load and full-load operation, on a pump-action rinsing zone being activated and/or on a clean-water rinsing zone being activated or not. In addition to the parameters listed above, the quantity of steam produced is also critically dependent on whether the dishwasher is used in part-load operation, e.g. for washing only lightly soiled glasses or plates, or whether the conveyor dishwasher is being used in full-load operation, for example for cleaning heavily soiled pots, pans or the like. Depending on the capacity at which the pumps are operating in the washing zones or preliminary rinsing zones, different levels of steam are produced, and these can be taken into account by means of the solution according to the invention of closing elements being opened in dependence on operating state. Vapors (clouds of steam) or moisture produced can thus be channeled away at the location where they are produced in each case, so that it is not possible for any vapors (clouds of steam) or moisture to pass out in the inlet or outlet region of the conveyor dishwasher.

The position of the wash ware within a certain zone of a conveyor dishwasher can be determined by suitable switching devices, which interrogate the respective zones, or via the machine-control means, which tracks the wash ware as it runs through the dishwasher. In dependence on the operating states, it is possible, for example by changing the speed of an exhaust-air fan or by actuating a closing element, which may be designed for example as a flap or a slide, to vary the overall quantity of exhaust air for the fan and/or to open or close the suction-extraction means to a greater or lesser extent at the various exhaust-air-channeling locations by suitably activated flaps and/or suitably arranged slides. On account of the opening cross sections, which are set by the different degrees of opening, the volume flow of air which is extracted by suction can be changed and adapted to the different operating states of the dishwasher in the respective washing or cleaning zones.

The control of one or more exhaust-air fans assigned to the dishwasher and/or of the at least one flap and of the at least one slide can be carried out both in steps and in a stepless manner and takes place in dependence on the incidence of vapors, steam and moisture-laden hot air in the respective operating states of the dishwasher.

The operating states which arise in a conveyor dishwasher may also be dependent, for example, on the respective position of the wash ware to be cleaned in the transporting direction since it is only possible to activate the clean-water rinsing zone and/or the pump-action rinsing zone in part-load operation when this is absolutely necessary.

The flaps and/or slides accommodated in the different zones of the dishwasher can be set in dependence on the "switched-on washing/rinsing zone" operating state and/or in dependence on different pumping capacities of the pumps assigned to the washing and/or the preliminary rinsing zone or can be preselected in dependence on the wash ware running through the respective drying zones of the dishwasher.

The capacity of an electric drive of an exhaust-air fan can be controlled in a particularly advantageous manner in dependence on the operating state of the dishwasher and/or the position of the at least one flap and/or of the at least one slide. In this case, the at least one flap and/or the at least one slide can be controlled directly or indirectly via the wash ware, which, for example—accommodated in a rack—comes into contact with, and deflects, a triggering lever. In addition, the at least one flap or the at least one slide may also be controlled electrically, pneumatically or hydraulically in dependence on the respective operating state of the dishwasher. The electric drive of the exhaust-air fan may be controlled via a speed-control means, for example in the form of a frequency converter, or via various coils of the electric drive of the fan motor. In the case of the frequency converter or via various coils of the electric drive of the fan motor, it is possible to change the capacity of the exhaust-air fan in dependence on the operating state of the machine. Furthermore, it is possible for the capacity of the exhaust-air fan or the electric drive thereof to be controlled via the at least one sliding element, in the form of a flap or of a slide, in dependence on the operating state of the dishwasher.

DRAWING

The invention is described in more detail hereinbelow with reference to the drawing, in which.

VARIANTS

Figure 1:
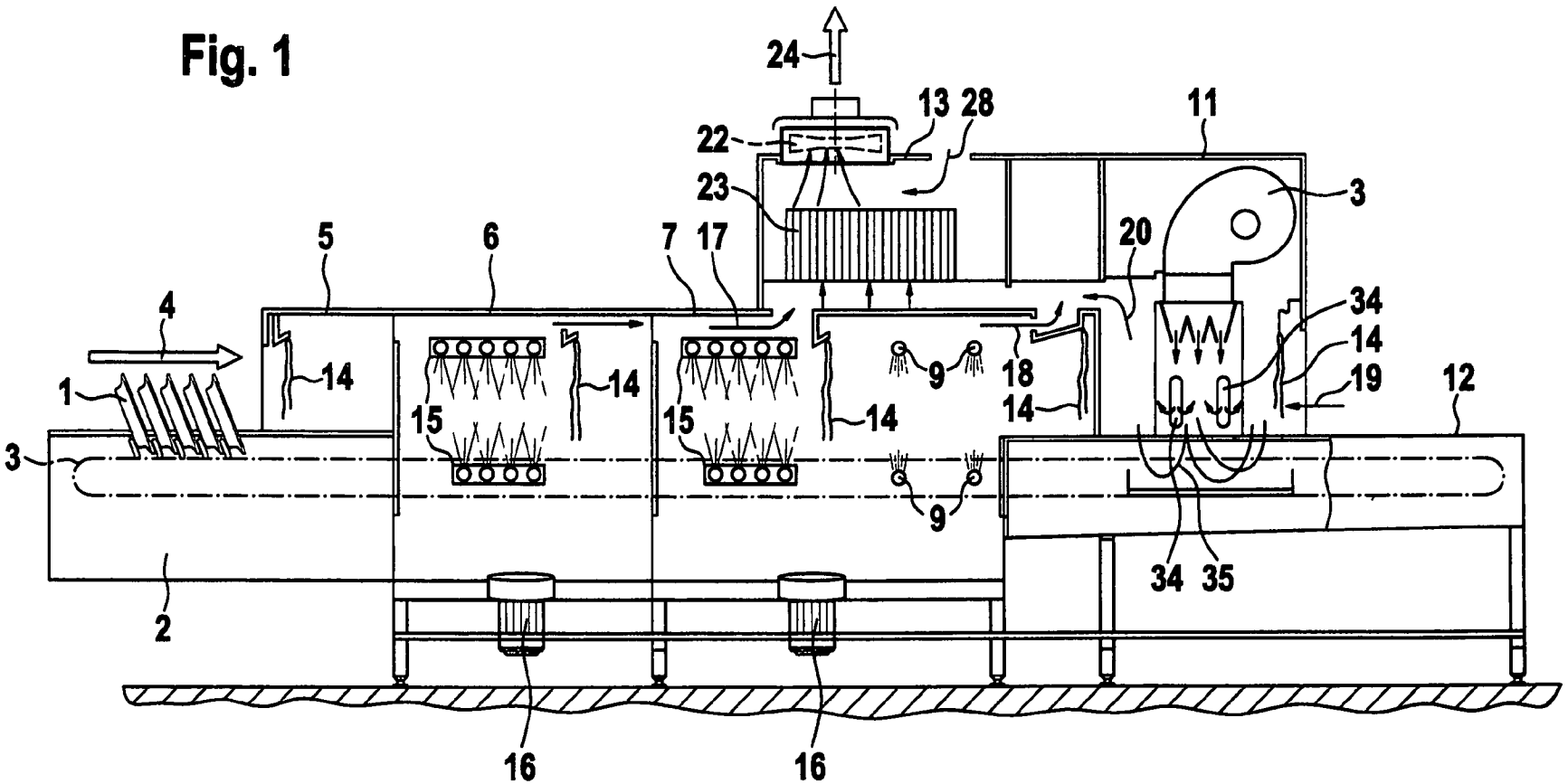
FIG. 1 shows a schematic section through a conveyor dishwasher with belt conveyor.

The illustration according to FIG. 1 shows, schematically, a belt-conveyor dishwasher.

It can be gathered from the illustration according to FIG. 1 that wash ware 1, which is illustrated for example in plate form, is accommodated in retaining means (not illustrated specifically) of a conveying belt 3. The conveying belt 3, which is preferably designed as a multi-part plastic conveying belt, is driven continuously by electric drives (not illustrated in FIG. 1) and conveys the wash ware 1 through the different zones of the dishwasher according to the illustration in FIG. 1. The wash ware 1, which is transported in the transporting direction 4, is usually positioned on the conveying belt 3 in the region of the inlet 2. The wash ware 1 is transported from the inlet 2 into an inlet tunnel 5 in accordance with the conveying direction 4, which is indicated by the arrow.

In the illustration according to FIG. 1, the conveying belt 3 is a circulating conveying belt. Further variants of the apparatus for transporting the wash ware 1 through the different zones of the dishwasher according to the illustration in FIG. 1 which may be mentioned are conveying racks, into which the wash ware 1 is inserted and which are positioned on the top side of the conveying belt 3. Instead of the circulating conveying belt 3 which is illustrated in FIG. 1, it is also possible to provide a chain or a ratchet rail for transporting the wash ware 1 through the dishwasher.

As seen in the transporting direction 4, the wash ware 1, which is either accommodated directly on the conveying belt 3 or is retained by racks, runs, in the transporting direction 4, through the inlet tunnel 5, the following preliminary rinsing zone 6, a washing zone 7, a pump-action rinsing zone 8, a clean-water rinsing zone 9 and a drying zone 11 into an outlet section 12. A heat-recovery device 13 is located above the washing zone 7. Air is withdrawn from the dishwasher via this heat-recovery device. Via the inlet tunnel 5, it is ensured that water does not spray into the inlet 2 from the preliminary rinsing zone 6. The inlet tunnel 5 itself is separated from the inlet 2 via a separating curtain 14. The separating curtain 14 prevents washing or rinsing water from spraying between zones and prevents the escape of vapors from the dishwasher.

The preliminary rinsing zone 6 contains washing systems 15, which are only schematically indicated in the illustration according to FIG. 1. The washing systems 15 ensure that the wash ware 1 is sprayed both from the top side and from the underside and that soiling and food residues are removed from the wash ware 1 in the preliminary rinsing zone 6. A pump 16 is integrated in the preliminary rinsing zone 6, this pump pumping the cleaning fluid into the washing systems 15, via which the fluid is applied to the wash ware 1. The pump 16 of the preliminary rinsing zone 6 is designed such that it can operate at different pumping capacities. From the preliminary rinsing zone 6, the wash ware 1 passes, by way of continuous advancement of the conveying belt 3, into the washing zone 7, in which washing systems 15 are likewise integrated above and beneath the conveying belt 3. These washing systems are subjected to the action of cleaning liquid (dishwashing liquor) via a pump 16. It is also possible for the pump 16 within the washing zone 7 to operate at different capacities.

Via a first opening 17, which is arranged in the ceiling of the washing zone 7, the clouds of steam (vapors) produced in the preliminary rinsing zone 6 and the washing zone 7 can be withdrawn from the preliminary rinsing zone 6 and the washing zone 7. The first opening 17 may also be located at the inlet of the dishwasher—although this is not illustrated in the drawing. The washing zone 7 is separated from the pump-action rinsing zone 8 via a further separating curtain 14. The pump-action rinsing zone 8 is followed by a clean-water rinsing zone 9, in which the wash ware 1 is rinsed. In the illustration according to FIG. 1, a further, second opening 18 may be located downstream of the clean-water rinsing zone 9, it being possible for clouds of steam (vapors) to be withdrawn from the pump-action rinsing zone 8 and/or the clean-water rinsing zone 9 via this second opening. A further separating curtain 14 is located beneath the second opening 18.

The clean-water rinsing zone 9 is followed by a drying zone 11. In the drying zone 11, the wash ware 1 is dried by way of dry, heated air in order to blow and dry off the moisture located on the wash ware 1. In order to keep the moisture content of the air in a range which is favorable for drying purposes, ambient air is fed via a further, third opening 19, for example through the exit opening for the wash ware 1. The hot, moisture-laden air is withdrawn from the drying zone 11 via a fourth opening 20.

In the heat-recovery device 13, the air streams which are extracted by suction via the first opening 17, the second opening 18 and the fourth opening 20 are channeled by a condenser 23 with the aid of a fan 22. Via the exhaust-air stream 24, the cold and dehumidified air transported out of the dishwasher via the heat-recovery device 13 is dissipated to the surrounding area or directed outward. Ambient air can be added, via the fifth opening 21 in the roof of the heat-recovery device 13, in order to reduce the moisture content of the air coming from the dishwasher.

It is also the case that the outlet section 12 is separated from the drying zone 11 via a further separating curtain 14, this avoiding the situation where the drying air which is blown into the drying zone 11 at a relatively high temperature exits outward in an uncontrolled manner.

It is not absolutely necessary for the first opening 17, the second opening 18, the fourth opening 20 and the fifth opening 21 to be provided in this number in a dishwasher. It is also possible to provide a larger or smaller number of these openings 17, 18, 20, 21 in order for the exhaust air to be subjected to the action of an exhaust-air fan 22 acting on all the openings. It is also possible for those positions of the openings 17, 18, 19, 20 and 21 which are illustrated according to FIG. 1 to be situated in a dishwasher at locations other than those depicted in FIG. 1.

Figure 2:
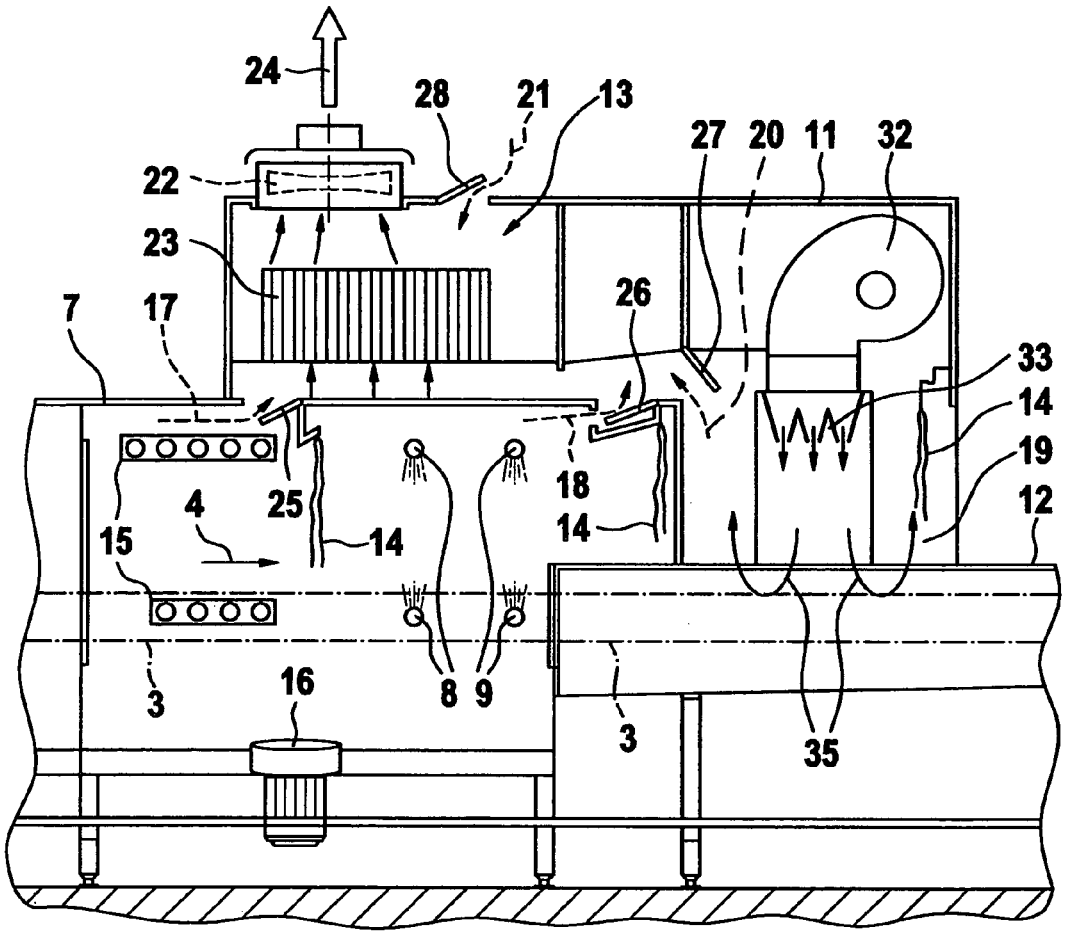
FIG. 2 shows flap-closable suction-extraction openings in different zones of the dishwasher according to the schematic illustration in FIG. 1.

Part of the dishwasher according to FIG. 1 can be gathered from the illustration according to FIG. 2.

That part of the dishwasher which is illustrated in FIG. 2 shows that a first flap 25, which controls the exhaust-air stream from the washing zone 7, is located above the washing systems 15 arranged in the washing zone 7. In the illustration according to FIG. 2, the first flap 25 is in a position in which it only partially releases the exit cross section of the first opening 17. The partial exhaust-air stream from the washing zone 7 passing through the first opening 17 is extracted by suction via the fan 22 assigned to the heat-recovery device 13, this partial exhaust-air stream passing through a condenser 23 and being channeled away as an exhaust-air stream 24.

Via a fourth flap 28, which is arranged in the roof of the heat-recovery device 13 and closes or releases a further, fifth opening 21, ambient air can be mixed with the exhaust-air stream passing out of the condenser 23. The exhaust-air stream passing out of the condenser 23 is saturated air which is extracted by suction from the different zones of the dishwasher. By virtue of the position of the fourth flap 28 relative to the cross section released by the further, fifth opening 21, it is possible to vary the fraction of ambient air which enters and is mixed with the overall exhaust-air stream of the dishwasher.

Furthermore, an exhaust-air stream enters into the condenser 23 via the second opening 18 in the region of the pump-action rinsing zone 8 and/or the clean-water rinsing zone 9. The second opening 18 is released or closed via a second flap 26 which is configured, for example, in a pivotable manner. A further separating curtain 14 is located beneath the pivot axis of the second flap 26. In addition, exhaust air passing out of the drying zone 11 enters into the condenser 23 of the heat-recovery device 13 via the fourth opening 20, which can be closed and released by a third flap 27, which is arranged in a pivotable manner.

The drying zone 11 accommodates a drying fan 32, in which air is heated and flows downward, out of the drying fan 32, into downstream exit nozzles 33. Located at the bottom end of the exit nozzles 33 are exit openings from which flow in the same direction is blown from above onto the wash ware 1 passing through the drying zone 11 by means of the conveying belt 3, the wash ware being dried off by this flow. The drying zone 11 is closed off from the outlet section 12 by a further separating curtain 14, a third opening 19 being formed beneath the further drying curtain 14, it being possible for ambient air to flow into the drying zone 11 from the outside via this third opening. The reference numeral 35 designates the flow path, within the drying zone 11, of the hot air which passes out via the fan 32 and the exit nozzles 33 thereof.

Accordingly, an exhaust-air stream which is extracted by suction from the preliminary rinsing zone 6 and the washing zone 7 enters into the condenser 23 of the heat-recovery device 13 via the first opening 17, an exhaust-air stream which passes out of the pump-action rinsing zone 8 and/or the clean-water rinsing zone 9 enters into said condenser via the second opening 18, and an exhaust-air stream which is withdrawn from the drying zone 11 enters into said condenser via the fourth opening 20, on the underside of the condenser 23.

For the sake of completeness, it should be mentioned that the wash ware 1—which is not represented specifically in the illustration according to FIG. 2—passes through the individual zones 7, 8, 9 and 11 of the dishwasher according to the illustration in FIG. 2 by means of the conveying belt 3 or racks which are accommodated thereon. Located beneath the washing zone 7 and/or the pump-action rinsing zone 8 and the clean-water rinsing zone 9 is a pump 16, which feeds the cleaning fluid to the washing systems 15, for example of the washing zone 7.

Vapors and steam can be withdrawn from the preliminary rinsing zone 6 and the washing zone 7 via the first opening 17. The degree of opening of the first flap 25 is dependent on whether the pumps 16 of the preliminary rinsing zone 6 or washing zone 7 are not operating or are not operating at maximum capacity. The second opening 18 above the pump-action rinsing zone 8 and the clean-water rinsing zone 9 serves for withdrawing vapors and steam from the pump-action rinsing zone 8 and the clean-water rinsing zone 9. The second opening 18 can be wholly or partially closed by the second flap 26 when the pumps of the pump-action rinsing zone 8 and/or of the clean-water rinsing zone 9 are not in operation. The fourth opening 20 for moisture-laden, hot air from the drying zone 11 can be wholly or partially closed by means of the third flap 27 if, in the drying zone 11, the air humidity for drying the wash ware 1 is still insufficient.

The further, fifth opening 21, which is formed in the roof of the heat-recovery device 13, serves for mixing ambient air with the saturated air which passes out of the condenser 23 of the heat-recovery device 13. The further, fifth opening 21 can be wholly or partially closed by means of the fourth flap 28 in order to change the fraction of ambient air which is mixed in each case. Furthermore, the capacity of the fan 22 of the heat-recovery device 13 can be varied such that it is possible to change the quantity of exhaust air and thus the overall quantity of exhaust air which is extracted by suction from the dishwasher. The closing elements 25, 26, 27, 28 can be rotated about their respective pivot axes, for example—as is indicated in FIG. 2—via electric drives which can be activated by the central machine-control means. The same applies for closing elements which are designed as slides, and can be partially or wholly displaced in position relative to the openings 17, 18, 19, 20, 21 by means of electric drives which are specifically assigned to them.

Figure 3:
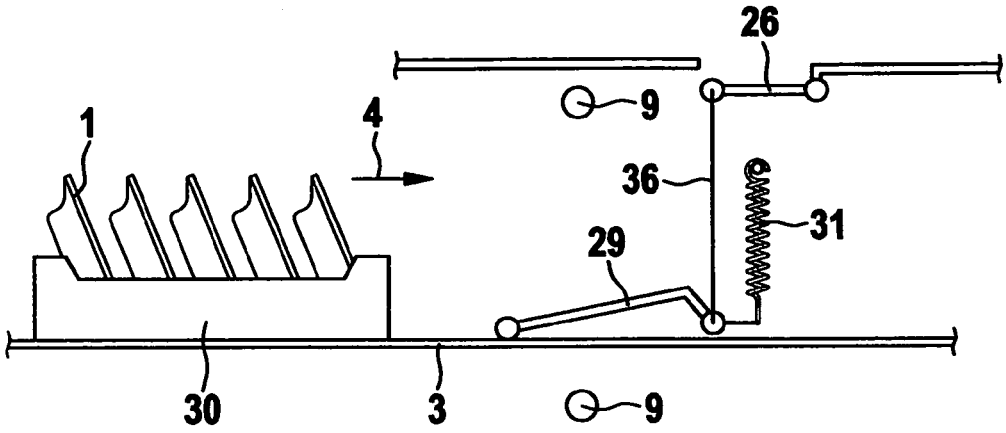
FIG. 3 shows a switching device which triggers, and releases a flap, as a conveying rack passes.
Figure 4:
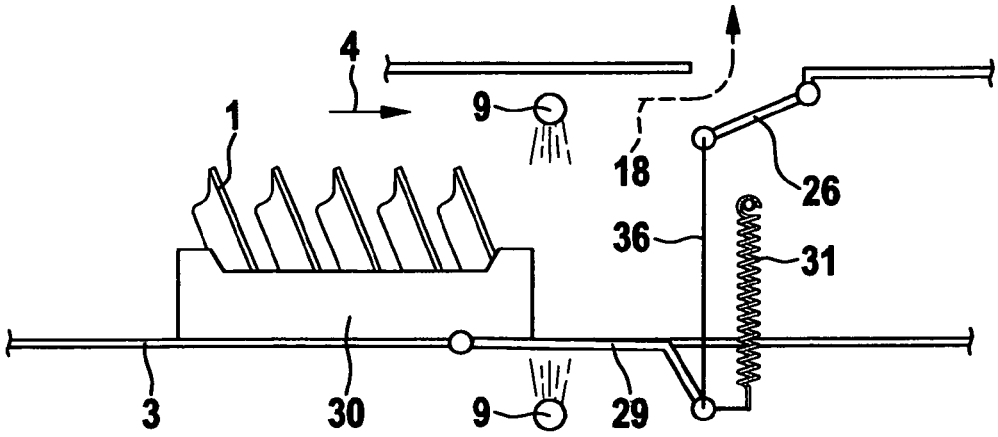
FIG. 4 shows a mimic which is triggered as a conveying rack, accommodating wash ware, passes and is intended for releasing a flap which closes a suction-extraction opening, the flap being set in an opening position.

The illustrations according to FIGS. 3 and 4 show variants in which the wash ware directly activates a pivotably designed flap element which closes an opening.

It can be gathered from FIG. 3 that the wash ware 1—in the form here of plates—is accommodated in a rack 30. The rack 30 can be transported through the individual zones 6, 7, 8, 9 and 11 of the dishwasher by means of a ratchet conveyor or a ratchet carriage or by being positioned on a plastic conveying belt 3. A lever element 29 is located upstream of the rack 30, as seen in the transporting direction 4. The lever 29, for its part, is articulated on a connecting rod 36, which is fitted with, for example, the second flap 26 (downstream of the pump-action rinsing zone 8 and/or the clean-water rinsing zone 9) above the inlet tunnel 5. In the state which is illustrated in FIG. 3, the clean-water rinsing zone 9 is not in operation, this being illustrated by the two spray tubes of the washing systems of the clean-water rinsing zone 9, which have no water jets passing out of them.

In the illustration according to FIG. 3, since the washing systems of the clean-water rinsing zone 9 are inactive, the second flap 26 is illustrated in its closed position, which is maintained by the restoring spring 31 acting on the lever element 29.

A flap which closes an exit opening is represented in a partially open position in the illustration according to FIG. 4.

It can be gathered from the illustration according to FIG. 4 that the rack 30, which is conveyed in the transporting direction 4 and contains the wash ware 1, has run onto the deflectable lever element 29. The lever 29 is thus moved essentially into its horizontal position and therefore draws the connecting rod 36 downward. As a result, on the one hand, the restoring spring 31 is prestressed, and on the other hand, the second flap 26 in the roof of the tunnel is partially opened, so that the second opening 18 in the roof of the inlet tunnel is partially opened in accordance with the deflection of the connecting rod 36. The deflection of the lever element 29 as a result of the rack 30 approaching activates the washing systems of the clean-water rinsing zone 9—this being indicated by the water jets passing out of the spray tubes in FIG. 4. Since steam or clouds of steam (vapors) forms or form in the clean-water rinsing zone 9 as water jets pass out of the spray tubes, it or they can flow out of the clean-water rinsing zone 9 via the partially released second opening 18 and the partially open position of the second flap 26 and—see the illustration according to FIGS. 1 and 2—is or are fed to the condenser 23 of the heat-recovery device 13.

The control of the respective closing elements 25, 26, 27 and 28, whether these are designed as pivotable flaps or as movable slides, takes place in dependence on the operating state of the dishwasher. If the dishwasher is used in partial-load operation, i.e. for cleaning only slightly soiled dishes, and if the preliminary rinsing zone 6 and/or the washing zone 7 are/is in operation, then the first flap 25 is, for example, only half open. If, in contrast, heavily soiled dishes such as, for example, pots, pans, baking sheets or the like are cleaned in full-load operation of the dishwasher, the first flap 25 is completely open.

If the pump-action rinsing zone 8 is switched off, then the second flap 25 is located in its closed position. If the drying zone 11 is switched on, i.e. the drying fan 32 arranged there is activated, then the third flap 27 is open, whereas, when the drying fan 32 arranged in the drying zone 11 is switched off, this third flap is closed. The fourth flap 28, e.g. arranged in the roof of the heat-recovery device 13, can be opened or closed in dependence on the degree of opening of the first flap 25, the second flap 26 and/or the third flap 27, in order for ambient air to be mixed with the exhaust-air stream 24. It is likewise possible to operate the exhaust-air fan 22 of the heat-recovery device 13 in dependence on the degree of opening or closing of the first flap 25, the second flap 26 and/or the third flap 27.

LIST OF DESIGNATIONS

1 Wash ware
2 Inlet
3 Conveying belt
4 Transporting direction (arrow)
5 Inlet tunnel
6 Preliminary rinsing zone
7 Washing zone
8 Pump-action rinsing zone
9 Clean-water rinsing zone
10
11 Drying zone
12 Outlet section
13 Heat-recovery device
14 Separating curtains
15 Washing systems
16 Pump
17 First opening
18 Second opening
19 Third opening
20 Fourth opening
21 Fifth opening
22 Fan
23 Condenser
24 Overall exhaust-air stream
25 First flap
26 Second flap
27 Third flap

28 Fourth flap
29 Lever element
30 Conveying rack
31 Restoring spring
32 Drying fan
33 Exit nozzles
34 Drying-air exit
35 Flow path of the drying air
36 Connecting rod

The invention claimed is:

1. A conveyor dishwasher having at least one washing zone, at least one rinsing zone, a heat-recovery device, a drying zone and a suction-extraction means, the dishwasher further comprising:

an exhaust-air fan employed in the suction-extraction means for exhausting air from a plurality of the zones through the heat-recovery device;

a plurality of openings provided between the zones and the suction-extraction means for conducting flows of air from the zones to the suction-extraction means;

a closing element provided at each opening for controlling the flow of air through the opening, each of the closing elements being movable between an open position, a wholly closed position and a partially closed position; wherein a capacity of the exhaust-air fan, and thus an exhaust-air quantity withdrawn through the heat-recovery device is controlled in dependence on the operating state or states; and wherein the movement of the closing elements between the open, wholly closed and partially closed positions is controlled in dependence on an operating state of individual ones of the zones of the dishwasher.

2. The conveyor dishwasher as claimed in claim 1, further comprising:

a speed control means for varying the capacity of the exhaust-air fan; and wherein the capacity of the exhaust-air fan can be varied via the speed-control means in dependence on the operating state or states.

3. The conveyor dishwasher as claimed in claim 2, wherein the speed-control means comprises a frequency converter or an electric drive of the exhaust-air fan with a multiple coil.

4. A process for operating a conveyor dishwasher as claimed in claim 1, wherein the suction extraction of air from the conveyor dishwasher takes place in dependence on the operating state or states of the conveyor dishwasher, the operating state or states being controlled by the disposition of wash ware in the dishwasher.

5. The process as claimed in claim 4, wherein the closing elements are wholly or partially closed when the at least one washing zone is switched off, the at least one rinsing zone is switched off and the drying zone is switched off, and when there is no wash ware located in these zones.

6. A conveyor dishwasher having at least one washing zone, at least one rinsing zone, a heat-recovery device, a drying zone and a suction-extraction means, the dishwasher further comprising:

an exhaust-air fan employed in the suction-extraction means for exhausting air from a plurality of the zones through the heat-recovery device;

a plurality of openings provided between the zones and the suction-extraction means for conducting flows of air from the zones to the suction-extraction means;

a closing element provided at each opening for controlling the flow of air through the opening, each of the closing elements being movable between an open position, a wholly closed position and a partially closed position; wherein the movement of the closing elements between the open, wholly closed and partially closed positions is controlled in dependence on an operating state of individual ones of the zones of the dishwasher; and wherein the movement of the closing elements between the open, wholly closed and partially closed positions is effected directly or indirectly by wash ware in the dishwasher via deflectable lever elements.

* * * * *